United States Patent [19]

Serras-Paulet

[11] 4,354,081

[45] Oct. 12, 1982

[54] PUSH-BUTTON OR KEYBOARD WITH DEPRESSABLE KEYS

[76] Inventor: Edouard Serras-Paulet, Casa Nostra Pech des Treilles, Puylaroque, France, 82240

[21] Appl. No.: 261,239

[22] PCT Filed: Nov. 28, 1979

[86] PCT No.: PCT/FR79/00114

§ 371 Date: Jul. 22, 1980

§ 102(e) Date: Jul. 22, 1980

[87] PCT Pub. No.: WO80/01219

PCT Pub. Date: Jun. 12, 1980

[30] Foreign Application Priority Data

Nov. 29, 1978 [FR] France ..... 78 33734

[51] Int. Cl.[3] ..... H01H 13/00

[52] U.S. Cl. ..... 200/340; 200/67 F; 200/159 B

[58] Field of Search ..... 200/340, 67 F, 159 B

[56] References Cited

U.S. PATENT DOCUMENTS

| | | | |
|---|---|---|---|
| 2,847,528 | 8/1958 | Combs | 200/67 F |
| 3,366,766 | 1/1968 | Umpleby | 200/67 F |
| 3,443,043 | 5/1969 | Schmid-Zeller | 200/67 F |
| 3,586,888 | 6/1971 | Dorfman | 200/67 F |
| 3,829,632 | 8/1974 | Klehm, Jr. | 200/159 B |
| 3,942,145 | 3/1976 | Sobczak | 200/67 F |
| 4,054,944 | 10/1977 | Lau | 200/67 F |

*Primary Examiner*—Willis Little

*Attorney, Agent, or Firm*—Kane, Dalsimer, Kane, Sullivan & Kurucz

[57] ABSTRACT

A keyboard or push-button having at least one depressible key for actuating a contact element and changing its conduction state, wherein the key is associated with at least one free piston adapted to actuate the contact element and having a stroke shorter than that of the key, so that the duration of the signal resulting from the actuation of the contact element is greater than a predetermined fraction of the total operation time of the key.

13 Claims, 7 Drawing Figures

PUSH-BUTTON OR KEYBOARD WITH DEPRESSABLE KEYS

FIELD OF THE INVENTION

The invention relates in general to electric or electronic switching devices, forming a push-button or a keyboard with depressable keys, with magnetic means for returning the push-button or the keys to their rest position.

BACKGROUND OF THE INVENTION

One knows already such push-buttons and such keyboards with depressable keys and magnetic return means, which have the advantage, relative to the known prior devices, of not using a return spring, and therefore of not presenting the disadvantages associated therewith (loss of rigidity, fatigue phenomenon, resonance phenomenon, sensitivity to corrosion, return force increasing in proportion to the path covered by the key or push-button when being depressed, sensitivity to vibrations and accelerations, etc.).

Said push-buttons and keyboards with keys and magnetic return means have nevertheless the disadvantage that the duration of the signal produced by depressing the push-button or key is far shorter than the total operation time of the push-button or key. In some applications, it is necessary that the signal has a duration representing at least 60% of the total operation time of the push-button or key.

SUMMARY OF THE INVENTION

For solving this problem, the invention provides an electric or electronic switching device, forming a push-button or a keyboard with depressable keys, comprising an upper plate formed with a hole through which extends the body of a button or key, a lower plate placed under the upper plate at a predetermined distance therefrom and carrying at least one contact or switching element intended for being brought by the key or button to a state of conduction or non-conduction according to whether the key or button is in a working position or in a rest position, the lower portion of the body of the key comprising means for returning the key or button to its rest position, said means cooperating thereto by magnetic attraction with the aforementioned upper plate, and the stroke of the key or button being such that the magnetic attraction force exerted by said return means on the key or button exceeds always the weight of the key or button, wherein the aforementioned key or button is associated with at least one free piston provided for operating or controlling, when the key or button is displaced from its rest position to its working position, the aforementioned contact or switching element carried in the lower plate in order to have its conduction state changed, said free piston having a stroke far shorter than the stroke of the key or push-button so that the duration of the electric signal resulting from the change of conduction state of the aforementioned element, when the key or button is operated, is superior to a predetermined fraction of the total operation time of the key or button, the free piston being axially movable relative to the key or button and being constantly subjected to a magnetic attraction force exerted by magnetic attraction means which are rigidly attached to the key or button.

Because the free piston has a stroke far shorter than the stroke of the associated key or push-button, it is caused to actuate very quickly the contact or switching element in order to change its conduction state as soon as the key or button leaves its rest position. The action of the free piston on the contact element lasts until the key or button is on the point of resuming its rest position. Thus, the duration of the electric signal produced by the change of conduction state of the contact element actuated by the key or push-button can be very slightly less than the total operation time of the key or button, and in any case always in excess of 60% of the total operation time of the key or button.

According to a further characteristic of the invention, the said magnetic means for returning the key or button to its rest position form also the magnetic attraction means of the free piston.

Said characteristic feature of the invention allows greatly simplifying the construction of a push-button or keyboard according to the invention and lowering its cost considerably.

BRIEF DESCRIPTION OF THE DRAWINGS

The invention will be better understood, and further objects, characterizing features, details and advantages thereof, will appear more clearly when reading the following explanatory description with reference to the accompanying diagrammatic drawings given by way of non limiting examples only and illustrating various embodiments of the invention, drawings wherein.

BEST WAYS FOR PERFORMING THE INVENTION

First of all, a description will be given, with reference to FIGS. 1 and 2, of a first embodiment of a keyboard according to the invention.

In these two Figures, there is shown only a portion of the keyboard, and a single key of said keyboard. One will understand easily that the keyboard according to the invention comprises a plurality of keys identical to the key which is shown, and mounted in the same manner.

Figure 1:
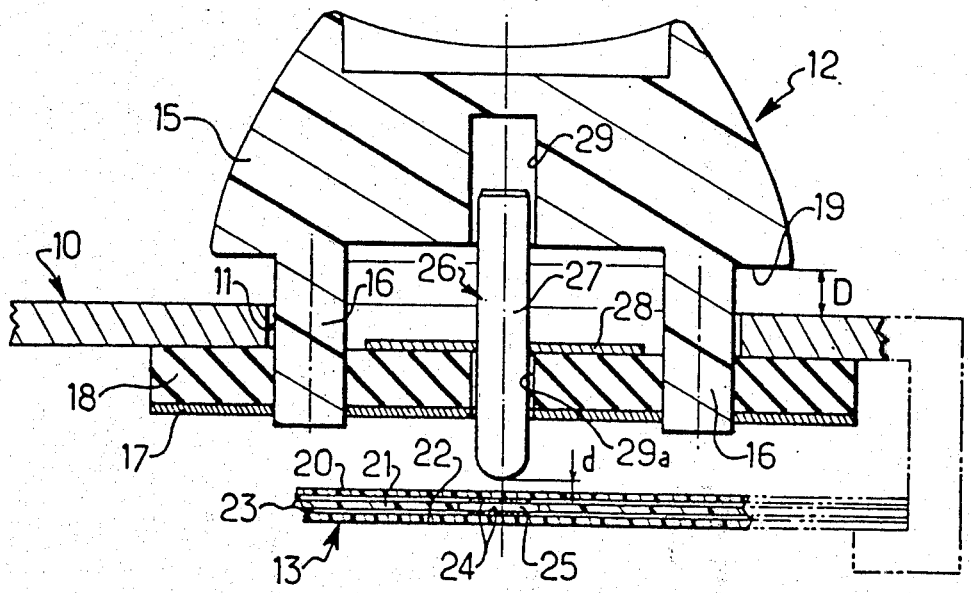
FIG. 1 is a partial sectional diagrammatic view of a keyboard according to the invention, the key of which is shown in its rest position.
Figure 2:
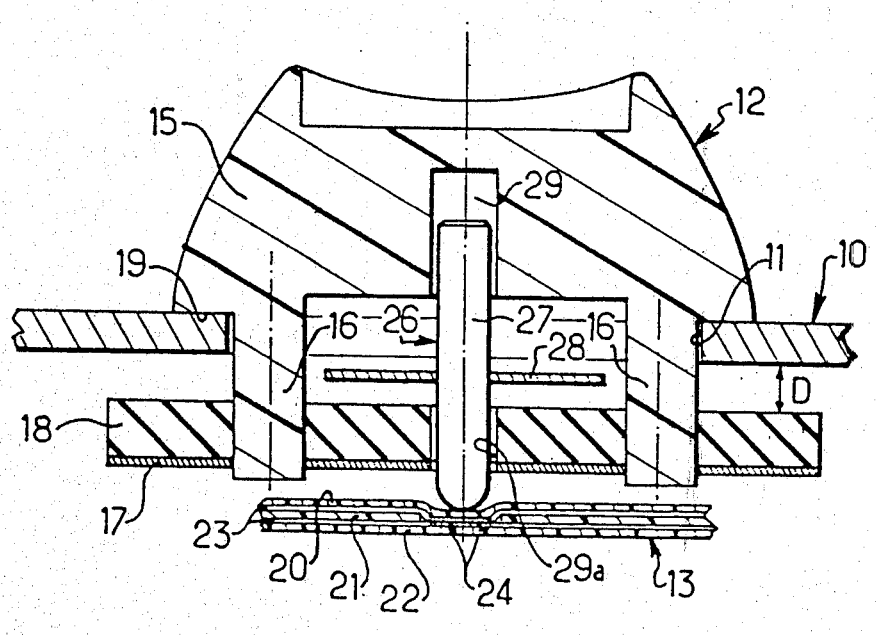
FIG. 2 is a view corresponding to FIG. 1, the key being represented in its working position.

The keyboard shown in FIGS. 1 and 2 comprises substantially a grid or apertured plate 10, forming the frontal face of the keyboard, and comprising a plurality of holes 11 through which extend keys 12. The keyboard comprises also a lower plate 13 carrying contact elements which are intended for being actuated by the keys 12 when the latter are depressed by a user.

As is shown diagrammatically in FIG. 1, in phantom lines, the lower plate 13 may be carried by a lower edge of the grid or apertured plate 10. Of course, any other connection or support mode of the plates 10 and 13 is also possible.

Each key 12 comprises a hood or head 15, extending above the grid 10, and which is rigidly connected to two stems 16 extending downwardly perpendicularly to the plane of grid 10, over a certain length. A plate or washer 17, made of soft iron or any other appropriate and similar material, is rigidly mounted by any appropriate means on the lower end of the stems 16. Said plate or washer 17 supports an upper plate 18 made of a magnetic material, for example a multipolar magnetic elastomer. The longitudinal dimensions of the plate or washer 17 and of the magnetic material plate 18 are widely superior to the dimensions of the opening 11 formed in the grid 10, while the lower face of the head 15 of the key 12 forms a peripheral edge 19 intended for coming to bear against the grid 10, as is shown in FIGS. 1 and 2.

The grid 10 is made of metal, for example iron or steel, sensitive to the magnetic field produced by the magnetic material plate 18. Thus, in its rest position, that is when no force is exerted on the key 12, said key is in the position shown in FIG. 1; the magnetic material plate 18 being kept, by magnetic attraction, in contact with the lower face of the grid 10. The distance D between the upper face of the grid 10 and the edge 19 of the key head 15 corresponds to the maximum stroke of the key.

The lower plate 13, carrying the contact or switching elements, which are adapted for being actuated by the keys 12, may be of any known type, as well as the switching and contact elements it carries. In the example shown, said plate 13 is formed by an assembly of three superimposed thin sheets, respectively 20, 21 and 22. The upper thin sheet 20 comprises, on its lower face, an electro-conductive network 23 and contact wafers 24. The intermediate thin sheet 21 serves only as insulation and spacing element, and comprises cut-outs 25 at the level of the contact wafers 24 of the first thin sheet 20. The lower thin sheet 22 is identical to the upper thin sheet 20, and carries, on its upper face, a conductive network 23 and contact wafers 24. The three sheets are disposed one on the other so that the contact wafers 24 of the two sheets 20 and 22 are in register one to the other, at the level of the cut-outs 25 of the intermediate sheet 21.

Such thin sheets are generally made of a flexible plastics material, such as that which is available on the market under the trade-name of "Mylar", which is electrically insulating and resiliently deformable. One needs only to exert a pressure, for example on the upper thin sheet 20 at the level of the cut-out 25, for bringing, by deformation of said sheet 20, the two wafers 24 in contact with each other. As soon as the pressure is removed, the sheet 20 returns to its initial position, the two wafers 24 being then separated from each other as is shown in FIG. 1. It can be stated that, in the example shown, the wafers 24 have a diameter of about 5 mm, that the "Mylar" sheets 20, 21 and 22 have a thickness of about 0.1 mm, and that one needs to exert on the sheet 20 or on the sheet 22 a force of about 5 g at the level of a cut-out 25 for bringing the two corresponding wafers 24 in contact with each other.

Of course, said assembly of three thin sheets 20, 21, 22 is supported by a rigide plate (not shown), advantageously made of an insulating material.

Each key 12 comprises further a free piston 26, mounted inside the key, and comprising an axial stem 27 extending parallel to the direction of the displacement of the key, and a plaquette or washer 28 made of a material such as soft iron or similar, which is rigidly connected to the stem 27. The latter may be made of a plastics material or any other appropriate material.

The stem 27 extends through a through-going central hole **29*a* formed in the magnetic material plate 18 and in the plate or washer 17 made of soft iron or similar. This washer 28 which is rigidly connected to the stem 27 is always disposed above the magnetic material plate 18. The upper end of the stem 27 is guided in a corresponding recessed hole 29 of the head 15 of the key 12**.

When the key 12 is in the rest position shown in FIG. 1, the washer 28 of the free piston 26 is applied, by magnetic attraction, on the upper face of the magnetic material plate 18 which is rigidly connected to the lower end of the stems 16 of the key 12. In this position, the lower end of the stem 27 of the free piston 26 is situated just above a group of contact wafers 24 carried by the aforementioned thin sheets 20 and 22. The distance d between the lower end of the stem 27 of the free piston and the upper face of the upper thin sheet 20 designates the dead stroke of the free piston 26.

This keyboard operates in the following manner.

When no force is applied on the key 12, said key is in the rest position shown in FIG. 1. In this position, the magnetic material plate 18 is applied on the lower face of the grid 10, and the washer 28 of the free piston 26 is applied on the magnetic material plate 18.

As soon as a user exerts on the key 12 a force directed downwardly and exceeding the magnetic attraction force developed between the grid 10 and the magnetic material plate 18, the key 12 leaves its rest position. The free piston 26 is caused to follow the movement of the key 12, due to the magnetic attraction of its washer by the plate 18, until the lower end of the stem 27 comes to bear against the thin sheet 20 at the level of the wafers 24 and deforms said thin sheet 20 by bringing the wafer 24 which it carries in contact with the wafer 24 carried by the lower thin sheet 22. The free piston is then in the position shown in FIG. 2. The key 12 can then continue its downward movement all along the stroke D until the edge 19 comes to bear against the upper face 10 of the grid 10. The key 12 is then in the position shown in FIG. 2.

In said position, the magnetic attraction force exerted on the washer 28 of the free piston 26 by the magnetic material plate 18 is still widely superior, not only to the force of 5 g which is necessary for deforming the upper thin sheet 20 and establishing the contact between the two wafers 24, but also to the weight of the free piston 26, so that, in this position, the keyboard remains insensitive to accelerations of the order of 10 g.

As soon as the user stops exerting a pressure on the key 12, said key returns to its rest position shown in FIG. 1. At the beginning of the return movement of the key 12, the free piston 26 remains in the position shown in FIG. 2, and even applies a pressure on the upper thin sheet 20 which increases as the key 12 returns to its rest position. The free piston 26 remains in this position until its washer 28 is lifted by the magnetic material plate 18 coming to bear against the lower face of the grid 10.

It will be stated as a non limiting example that the stroke D of the key 12 may be of 3 mm about, while the stroke d of the free piston 26 may be of 0.1 to 0.2 mm about.

An electric signal is produced as soon as the two wafers 24 of the sheets 20 and 22 are brought in mutual contact by the free piston 26. The duration of said electric signal is only slightly less than to the total operation time of the key 12, and is in any case widely superior to 60% of said total time.

The magnetic attraction force exerted by the magnetic material plate 18, that is the magnetic return force of the key 12 in its rest position, is, in said example, of the order of 150 g about for a thickness of the plate 18 of the order of 1.5 mm. The bearing force of the free piston 26 on the upper thin sheet 20 varies between a maximum value of the order of 60 g and a minimum value of the order of 25 g.

It will be understood that the plate or washer 17, made of soft iron or similar, which is rigidly connected to the lower end of the stem 16 of the key 12, performs a double function: it supports rigidly the magnetic material plate 18, and it cancels the magnetic field on the lower face of plate 18, while reinforcing it in a large proportion on the upper face of said plate 18.

A description will now be given of the embodiment of the invention shown in FIGS. 3 and 4.

This embodiment differs from that of FIGS. 1 and 2 in that the grid 30, in the holes of which are mounted the keys 12, comprises an upper metallic plate 31, on the lower face of which is fixed a magnetic material plate 32 such as a multipolar magnetic elastomer. The parallel stems 16 extending from the head 15 of the key 16 are rigidly connected, at their lower end, to a plate or washer 17 made of soft iron or similar, in the same manner as in the embodiment of FIG. 1, but said plate 17 supports solely a washer 33 made of a magnetic material such as a multipolar magnetic elastomer. Said washer 33 is disposed between the stems 16, so as to surround the hole 29*a* of washer 17, through which extends the stem 27 of the free piston 26.

Figure 3:
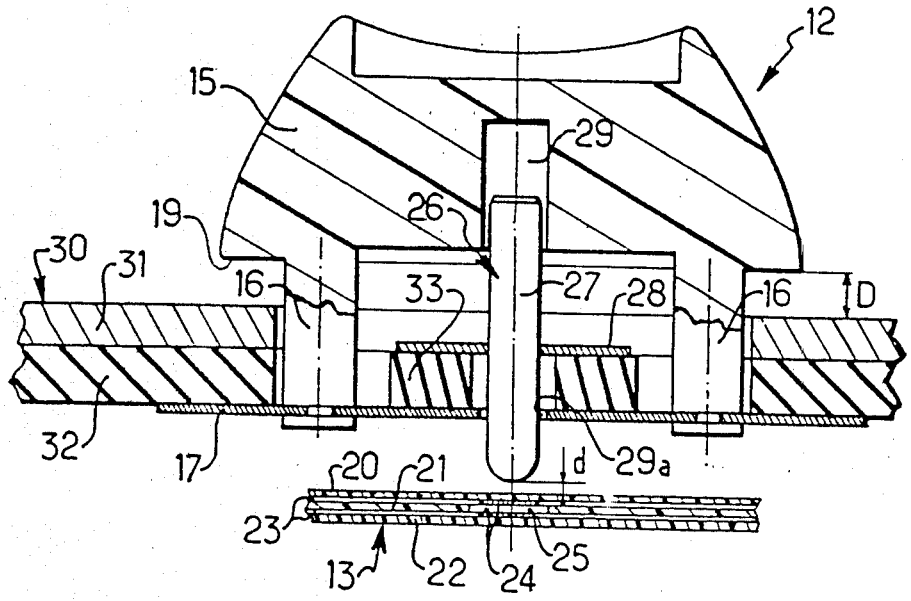
FIG. 3 is a view similar to FIG. 1, but showing an alternative embodiment of the keyboard according to the invention, with the key in its rest position.
Figure 4:
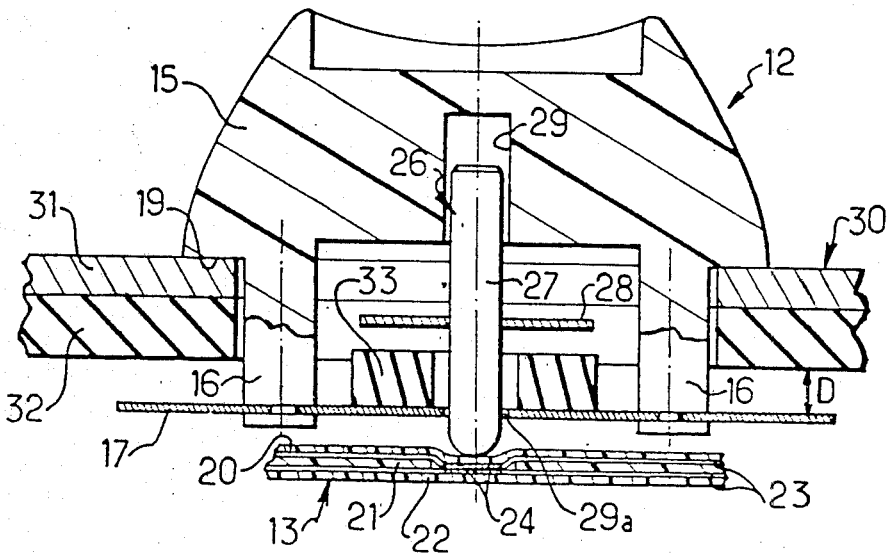
FIG. 4 is a view corresponding to FIG. 3, showing the key in its working position.

In the rest position shown in FIG. 3, the washer or plate 17 made of soft iron is applied on the lower face of the magnetic material plate 32, by magnetic attraction. The washer 28 of the free piston 26 is applied, by magnetic attraction, on the upper face of the washer 33 carried by the plate or washer 17. As previously, the stroke d of the free piston 26 is far less than the stroke D of the key 12.

As soon as a user depresses the key 12 with a force superior to the magnetic return force exerted on the washer 17 by the magnetic material plate 32, the key 12 leaves its rest position and moves down towards the lower plate 13 carrying the contact elements. As in the first embodiment, the free piston 26 follows the key 12 until the lower end of its stem 27 comes to bear against the upper thin sheet 21 and deforms it by bringing the wafer 24 in contact with the wafer 24 carried by the lower thin sheet 22. From this moment, the key 12 continues moving down until the edge 19 comes in abutment against the upper face of the metallic plate 31, as is shown in FIG. 4, when the user stops depressing the key 12, said key returns to its rest position and ends by lifting back the free piston 26 by drawing apart the lower end of its stem 27 from the plate 13 carrying contacts.

It will be understood that in this embodiment also, the duration of the signal produced by the contact of two wafers 24 is very slightly less than the total operation time of the key 12.

Figure 5:
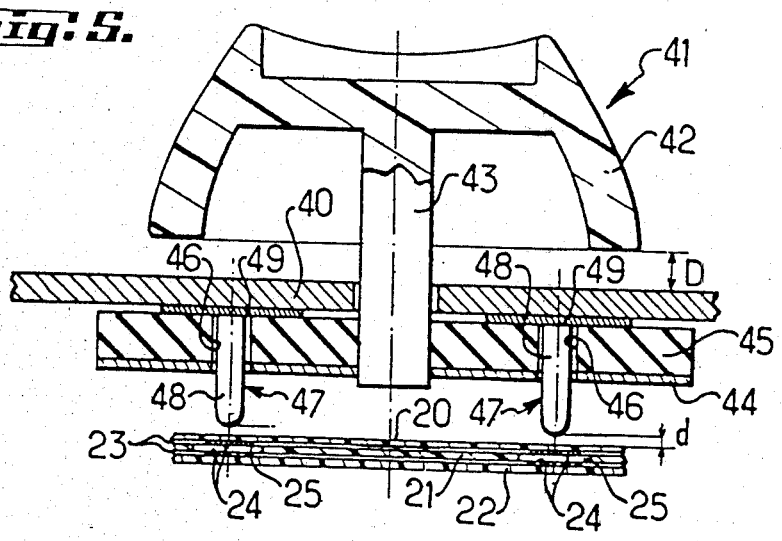
FIG. 5 is a partial sectional diagrammatic view of a further embodiment of a keyboard according to the invention, the key being shown in its rest position.
Figure 6:
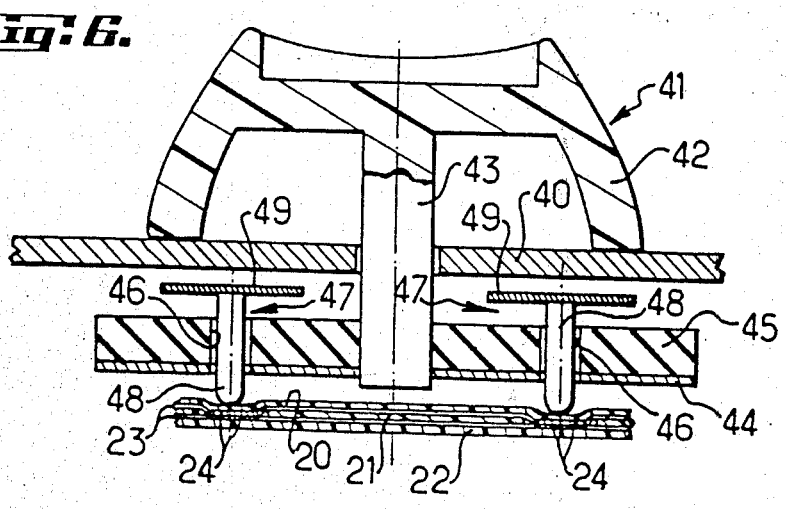
FIG. 6 is a view corresponding to FIG. 1, showing the key in its working position.

There is shown in FIGS. 5 and 6 a further alternative embodiment of a keyboard according to the invention, in which each key is associated with two free pistons.

In this embodiment, the grid 40 of the keyboard is made of a simple metallic plate, for example in iron or steel. Each key 41 comprises a head 42 mounted in an appropriate manner on the upper end of a stem 43 the lower end of which is rigidly connected to a plate or washer 44 made of soft iron or a similar material. This plate or washer 44 carries a plate 45 made of a magnetic material, for example a multipolar magnetic elastomer.

It will be understood that the key 41 is normally returned to its rest position shown in FIG. 5 by magnetic attraction between the grid 40 and the magnetic material plate 45. As previously the soft iron plate or washer 44 serves to support the magnetic material plate 45, and to cancel the magnetic field on the lower face of said plate and to reinforce it on its upper face.

The plates 44 and 45 are formed with two through-going holes 46, which are for example symmetrical relative to the central stem 43 of the key 41. Two free pistons 47 are freely mounted in said through-going holes 46. Each free piston 47 comprises a stem 48 extending into the hole 46 and a washer 19, for example made of soft iron or a similar material, rigidly connected to the upper end of the stem 48. Said stem 48 may be made of any appropiate material, for example a plastics material.

In the rest position of the key 41 shown in FIG. 5, the washer 49 of each free piston 47 is applied, by a magnetic attraction, on the upper face of the magnetic material plate 45. The latter is itself applied under the lower face of the grid 40, the washer 49 being thus squeezed between the grid 40 and the magnetic material plate 45. In this position, each stem 48 extends under the plates 45 and 44 towards a contact assembly, for example similar to those of the two first embodiments, and formed by the three superimposed thin sheets 20, 21 and 22. Of course, the wafers 24 carried by the sheets 20 and 22 are placed just below the lower end of the stems 48 of the free pistons 47. The distance d between the lower end of the stems 48 and the upper face of the upper thin sheet 20 corresponds to the stroke of each free piston 47, while the distance D represents, as previously, the stroke of each key 41.

This embodiment shown in FIGS. 5 and 6 operates as the two previous embodiments: as soon as a user depresses the key 41 with a force which exceeds the magnetic return force of said key, the key leaves its rest position and moves down towards the contact assembly formed by the thin sheets 20, 21 and 22, while driving with it the free pistons 47 until the lower ends of their stem 48 have deformed the upper thin sheet 20, as is shown in FIG. 6. The key 41 continues moving towards its working position shown in FIG. 6, where the lower edge of its head 42 is in abutment against the grid 40. When the user stops exerting a pressure on the key 41, said key moves back to its rest position shown in FIG. 5, and ends by lifting with it the free pistons 47, when it reaches the vicinity of its rest position.

It will be understood that in this embodiment also, the duration of the contact established by depressing the key is very slightly less than the total operation time of the key.

In the three embodiments just described with reference to FIGS. 1 to 6, the contact or switching elements actuated by the keys are contact wafers carried by thin sheets, for example in "Mylar" and associated with electroconductive networks (also carried by said thin sheets) allowing to connect them with appropriate electric or electronic circuits.

It will be understood that since the three sheets 20, 21 and 22 are fixed together in any appropriate manner, for example by gluing, ultrasound welding, etc., the contacts thus formed are perfectly tight.

It is obvious that one can also use contact elements of any type, the conduction state of which can be modified by a pressure.

On the other hand, the three embodiments just described relate to keyboards with multiple depressable keys. These three embodiments could also be used as push-buttons, meaning they could comprise a casing having a single key, its bottom being formed by a plate carrying one or several contact or switching elements.

Figure 7:
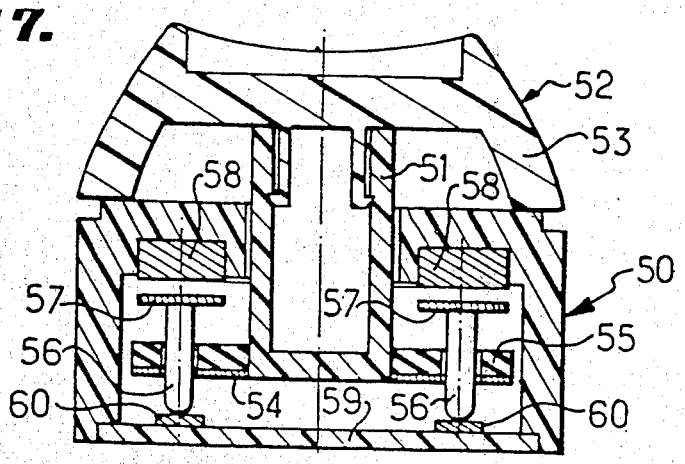
FIG. 7 is a sectional diagrammatic view of an embodiment of a push-button according to the invention.

Such an example of push-button, corresponding to the embodiment of FIGS. 5 and 6, is shown in FIG. 7.

The push-button shown in FIG. 7 comprises substantially a casing 50, the upper face of which comprises an opening through which is freely mounted the stem 51 of a key 52. Said key 52 comprises a head 53 which is mounted for example by a resilient snap-in arrangement at the upper end of the stem 51, the lower end of which is rigidly connected to a soft iron plate or washer 54 supporting the plate 55 made of a magnetic material such as a multipolar magnetic elastomer.

As in the embodiment shown in FIGS. 5 and 6, free pistons comprising a stem 56 rigidly connected at its upper end to a soft iron washer 57 extend freely through the plates 54 and 55. The inner face of the upper wall of the casing 50 comprises a built-in washer 58, for example of soft iron, forming with the magnetic material plate 55 the magnetic means returning the key 52 to its rest position.

The bottom of casing 50 is formed by a rigid plate 59, comprising contact or switching elements 60 which are intended for changing their switching state as soon as a pressure is applied to them by the stems 56 of the free pistons.

This push-button, which is shown in FIG. 7 in its working position, operates exactly in the same manner as the embodiment of the keyboard shown in FIGS. 5 and 6.

POSSIBILITIES OF INDUSTRIAL APPLICATIONS

One will now appreaciate that the invention allows constructing push-buttons and keyboards with multiple depressable keys and magnetic return means, adapted for controlling contact or switching elements, in order to have their conduction state changed in such a way that the signals produced by the conduction state changes of said elements have a duration which is slightly less than the total operation time of the keys or push-buttons.

It will be noted that the duration of said electric signals can be changed if one modifies the stroke d of the free pistons according to the invention. The shorter the distance d, the closer the duration of the electric signals comes to the total operation time of the push-buttons or of the corresponding keys.

The invention is of course not limited to the embodiments described and shown and which were given only by way of examples. In particular, it comprises all the means forming technical equivalents of the described means, as well as their combinations, provided the latter are carried out according to its spirit.

What is claimed is:

1. A switch device comprising; an upper plate formed with a hole, a depressable key extending through said hole and being movable between a rest and a working position, return means provided on the lower end of the key and cooperating by megnetic attraction with the upper plate for returning the key from its working position to its rest position, a free piston guided within the device for reciprocal movement relative to the key and in the same direction as the key, a lower plate located under the upper plate at a distance therefrom, a switchable element carried by the lower plate and adapted to be actuated by the free piston when the key is depressed from its rest position, and magnetic means being provided on the key and the free piston and cooperating with each other for permanently exerting a magnetic attraction force on the free piston.

2. A device according to claim 1 wherein the magnetic means are provided on the lower end of the key and on an upper end of the free piston respectively, and said free piston extending through the lower end of the key.

3. A device according to claim 1 wherein the free piston is movable between a rest and a working position and the stroke of the free piston is shorter than the stroke of the key between its rest and working positions.

4. A device according to claim 2 wherein the magnetic means provided on the lower end of the key for exerting a magnetic attraction force on the free piston form also a part of the means for returning the key to its rest position by magnetic attraction with the upper plate.

5. A device according to claim 4 wherein the lower end of the key comprises a plate of magnetic material having a hole through which the free piston extends, and the upper end of the free piston comprises a plate of soft iron.

6. A device according to claim 5 wherein said plate of magnetic material on the lower end of the key comprises a plate of soft iron supporting an upper layer of a multipolar magnetic elastomer.

7. A device according to claim 4 wherein the lower end of the key comprises a plate of soft iron having a hole through which extends the free piston, and the upper plate comprises a layer of magnetic material.

8. A device according to claim 7 wherein the layer of magnetic material is of a multipolar magnetic elastomer and is covered by a metallic plate.

9. A device according to claim 7 wherein the upper end of the free piston comprises a plate of soft iron and the plate provided on the lower end of the key supports an upper layer of magnetic material disposed under the plate of soft iron on the upper end of the free piston.

10. A device according to claim 1 wherein several free pistons are associated to the key.

11. A device according to claim 1 forming a push-button wherein said upper plate forms the upper wall of a casing the bottom of which is formed of the lower plate carrying the switchable element.

12. A device according to claim 1 forming a keyboard with a plurality of keys wherein said upper plate has a plurality of holes through which extend said keys, the lower plate carrying a plurality of switchable elements adapted to be actuated by the free pistons associated to the keys.

13. A device according to claim 1 wherein the duration of a signal produced by said switchable element when actuated by the free piston is at least equal to 60% of the total operation time of the key.

* * * * *